US006389600B1

(12) United States Patent
Di Maio

(10) Patent No.: US 6,389,600 B1
(45) Date of Patent: May 21, 2002

(54) SHIRT FOR A USER WEARING PANTS AND FOR PREVENTING SAND FROM ENTERING THE PANTS WHEN THE USER SLIDES

(76) Inventor: John F. Di Maio, 101 Merrit St., West Islip, NY (US) 11795

( * ) Notice: Subject to any disclaimer, the term of this patent is extended or adjusted under 35 U.S.C. 154(b) by 0 days.

(21) Appl. No.: 09/838,210

(22) Filed: Apr. 19, 2001

(51) Int. Cl.[7] ..... A41B 1/08
(52) U.S. Cl. ..... 2/121; 2/46; 2/115
(58) Field of Search ..... 2/121, 46, 51, 2/115, 117, 120, 122

(56) References Cited

U.S. PATENT DOCUMENTS

| | | | | |
|---|---|---|---|---|
| 1,641,318 A | | 9/1927 | Carey | |
| 1,612,766 A | | 12/1927 | Levinson | |
| 2,179,631 A | | 11/1939 | Holder | 2/22 |
| 2,263,538 A | * | 11/1941 | Freirich | 2/51 |
| 2,516,598 A | | 7/1950 | Selkirk | 2/2 |
| 2,562,234 A | * | 7/1951 | Gottschalk | 2/117 |
| 4,689,829 A | | 9/1987 | Kaplan | 2/46 |
| 4,987,610 A | | 1/1991 | Hunt | 2/46 |
| 5,267,352 A | * | 12/1993 | Rodarmel | 2/2 |
| 5,839,628 A | * | 11/1998 | Freese | 223/37 |
| 6,088,831 A | * | 7/2000 | Jensen et al. | 2/2.5 |
| 6,185,745 B1 | * | 2/2001 | Alger | 2/107 |

* cited by examiner

*Primary Examiner*—John A. Calvert
*Assistant Examiner*—Alissa L. Hoey
(74) *Attorney, Agent, or Firm*—Richard L. Miller

(57) ABSTRACT

A shirt for a user wearing pants and for preventing sand from entering the pants when the user slides. The shirt includes a body, a pair of sleeves, a neck band, a shirttail, a front placket, and a flap that extends circumferentially and completely therearound and depends from where the body meets the shirttail. The flap has openings that align with, and allow passage through, of belt loops on the pants When the shirttail is in the pants and the belt loops extend through the openings in the flap, a belt is passed through the belt loops and overlies the flap, and when the belt is fastened, the belt presses the flap against the waistband of the pants and traps the waistband of the pants between the flap and the shirttail, and in doing so, prevents the sand from entering the pants when the user slides.

11 Claims, 1 Drawing Sheet

SHIRT FOR A USER WEARING PANTS AND FOR PREVENTING SAND FROM ENTERING THE PANTS WHEN THE USER SLIDES

BACKGROUND OF THE INVENTION

1. Field of the Invention

The present invention relates to a shirt. More particularly, the present invention relates to a shirt for a user wearing pants and for preventing sand from entering the pants when the user slides.

2. Description of the Prior Art

Numerous innovations for protective garments have been provided in the prior art that will be described. Even though these innovations may be suitable for the specific individual purposes to which they address, however, they differ from the present invention.

A FIRST EXAMPLE, U.S. Pat. No. 1,612,766 to Levinson teaches a garment that includes a belt portion, an inner cushion pad secured to the belt portion, said pad having a row of eyelets arranged transversely of said pad, an outer cushion pad and an intermediate detachable cushion pad carried by the inner pad by means of lacing extending through said eyelets, said outer and intermediate pads being slidable with relation to each other and with respect to the inner pad, and means for limiting the movement of said outer and intermediate pads, said last mentioned means being connected to the inner pad and outer pad at opposite sides thereof, said means consisting of relatively narrow bands of material extending beyond the edges of the inner and outer pads and permitting the free end of the intermediate pad to move between said inner and outer pads.

A SECOND EXAMPLE, U.S. Pat. No. 1,641,318 to Carey teaches a sliding pad comprising three or more superimposed layers of padding material secured together along the upper edge of the pad, the remaining edges being unattached and permitting free relative sliding movement of the layers over one another, and means for attaching the pad to the wearer.

A THIRD EXAMPLE, U.S. Pat. No. 2,179,631 to Holder teaches a protective garment for athletic wear, comprising a padded pants-like garment having a belt enclosing waistband at the top and having a closed crotch and a wide V-shaped fly opening extending upwardly at the front thereof, and a belt forming member extending through said belt enclosing waistband adapted to be secured in said fly opening without a shirring or an overlapping at the waistband of the garment.

A FOURTH EXAMPLE, U.S. Pat. No. 2,516,598 to Selkirk teaches a personnel protecting garment for covering the buttocks, hops, portions of the thighs, and knee caps, comprising a pair of members each having a waist engaging upper edge and a depending portion forwardly offset with respect to said upper edge; said depending portions having lower edges extending below the knees of the wearer, forward edges recessed rearwardly to define a ventral gap from the abdominal region to regions above the knees of the wearer, and rear edges recessed forwardly to define a dorsal gap downwardly from the buttocks of the wearer.

A FIFTH EXAMPLE, U.S. Pat. No. 4,689,829 to Kaplan teaches an improved covering device to be used by skiers for protection against snow and moisture that has accumulated on the seat of a chair lift. The device comprises a waterproof pad that hangs from the rear of a belt secured about the skier's waist. The pad is rolled up to the belt for storage between periods of use and is held in the stored position by elastic loops slipped over the ends of the roll.

A SIXTH EXAMPLE, U.S. Pat. No. 4,987,610 to Hunt teaches a slide garment for use in athletic activities and particularly for use by baseball players in which an apron or a separate material flap is secured to the jersey or shirt of the uniform in an area such that the upper edge of the apron will extend above the belt line or waistband of the pants of the uniform when the Jersey is tucked within the pants and wherein the apron extends downwardly over the belt or waistband of the uniform and includes fastening elements for securing the lower portion of the apron to the upper portion of the pants to thereby prevent dirt and debris from entering between the pants and the Jersey. In one embodiment, a simulated belt or waistband may be provided across the front surface of the apron.

It is apparent that numerous innovations for protective garments have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a shirt for a user wearing pants and for preventing sand from entering the pants when the user slides that avoids the disadvantages of the prior art.

ANOTHER OBJECT of the present invention is to provide a shirt for a user wearing pants and for preventing sand from entering the pants when the user slides that is simple and inexpensive to manufacture.

STILL ANOTHER OBJECT of the present invention is to provide a shirt for a user wearing pants and for preventing sand from entering the pants when the user slides that is simple to use.

BRIEFLY STATED, STILL YET ANOTHER OBJECT of the present invention is to provide a shirt for a user wearing pants and for preventing sand from entering the pants when the user slides. The shirt includes a body, a pair of sleeves, a neck band, a shirttail, a front placket, and a flap that extends circumferentially and completely therearound and depends from where the body meets the shirttail. The flap has openings that align with, and allow passage through, of belt loops on the pants. When the shirttail is in the pants and the belt loops extend through the openings in the flap, a belt is passed through the belt loops and overlies the flap, and when the belt is fastened, the belt presses the flap against the waistband of the pants and traps the waistband of the pants between the flap and the shirttail, and in doing so, prevents the sand from entering the pants when the user slides.

The novel features which are considered characteristic of the present invention are set forth in the appended Claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows.

LIST OF REFERENCE NUMERALS UTILIZED IN THE DRAWING

First Embodiment

Figure 1:
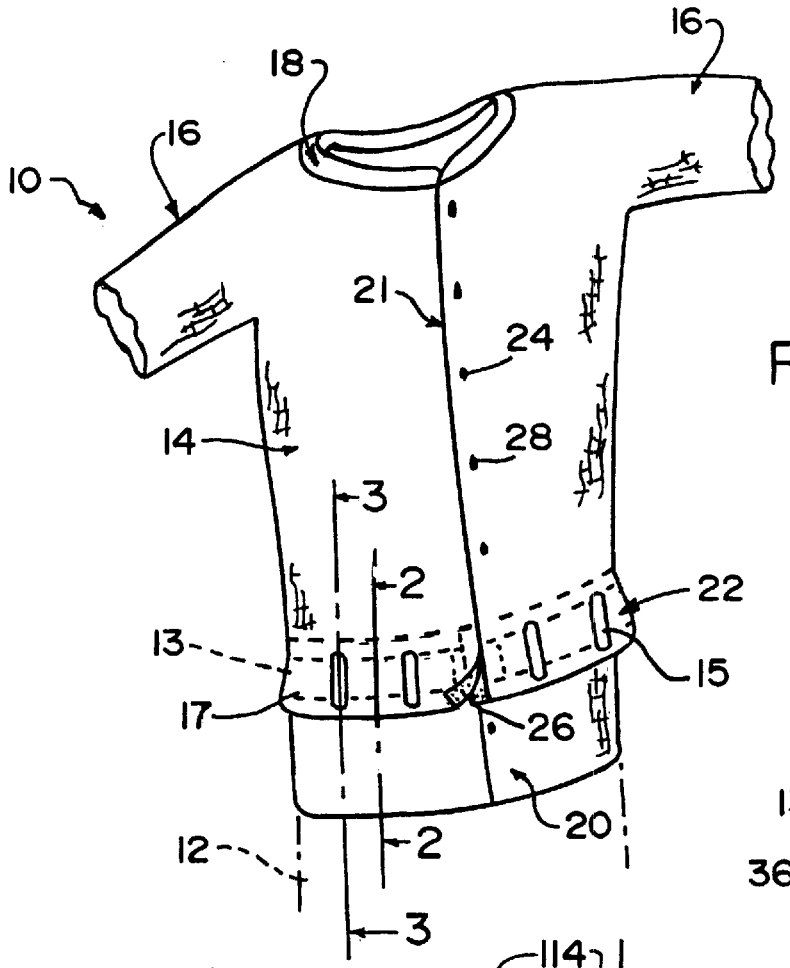
FIG. 1 is a diagrammatic perspective view of a first embodiment of the present invention.

10 shirt of present invention for user wearing pants 12 and for preventing sand from entering pants 12 when user slides
12 pants
13 waistband of pants 12
14 body
15 belt loops on waistband 13 of pants 12
16 pair of sleeves
17 belt
18 neck band
20 shirttail for engaging in pants 12
21 front placket
22 flap overlapping waistband 13 of pants 12 when shirttail 20 is in pants 12, and in doing so, prevents sand from entering pants 12 when user slides
24 fasteners
26 hook and loop fasteners of fasteners 24
28 snaps of fasteners 24
30 front portion of flap 22 for directly underlying belt 17
32 back portion of flap 22 for directly overlying waistband 13 of pants 12
34 channel in flap 22
36 opening in flap 22

Second Embodiment

110 shirt of present invention
114 body
122 flap
130 front portion of flap 122

Third Embodiment

210 shirt of present invention
214 body
220 shirttail
222 flap
230 front portion of flap 222

DETAILED DESCRIPTION OF THE PREFERRED EMBODIMENT

Referring now to the figures, in which like numerals indicate like parts, and particularly to FIG. 1, a first embodiment of the shirt of the present invention is shown generally at 10 for a user wearing pants 12 and for preventing sand from entering the pants 12 when the user slides, wherein the pants 12 has a waistband 13 with belt loops 15 that receive a belt 17.

The general configuration of the shirt 10 can best be seen in FIG. 1, and as such, will be discussed with reference thereto.

The shirt 10 comprises a body 14, a pair of sleeves 16 that extend oppositely from the body 14, a neck band 18 that is disposed on the body 14, between the pair of sleeves 16, a shirttail 20 that depends from the body 14 for engaging in the pants 12, and a front placket 21 that extends from the neck band 18 to the shirttail 20.

The shirt 10 further comprises a flap 22 that extends circumferentially and completely therearound, depends from where the body 14 meets the shirttail 20, and is for overlapping the waistband 13 of the pants 12 when the shirttail 20 is in the pants 12, and in doing so, prevents the sand from entering the pants 12 when the user slides.

The flap 22 is divided at, so as to communicate with, the front placket 21.

The shirt 10 further comprises fasteners 24 that selectively close the front placket 21.

The fasteners 24 comprise hook and loop fasteners 26 on the flap 22 and snaps 28 elsewhere.

Figure 2:
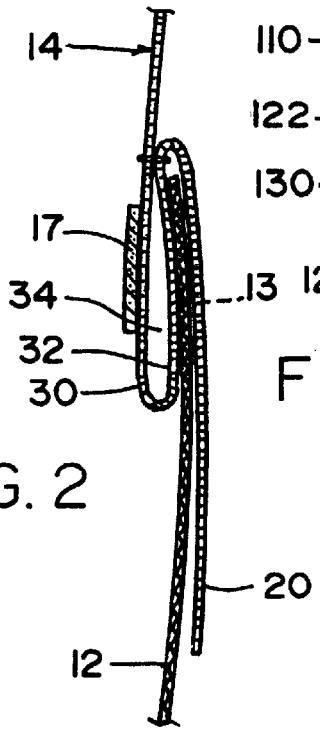
FIG. 2 is an enlarged diagrammatic cross sectional view taken on line 2—2 in FIG. 1.
Figure 3:
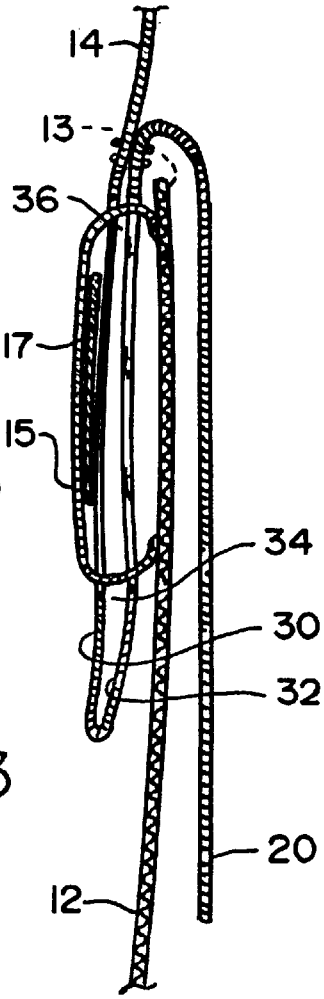
FIG. 3 is an enlarged diagrammatic cross sectional view taken on line 3—3 in FIG. 1.

The specific configuration of the flap 22 can best be seen in FIGS. 2 and 3, and as such, will be discussed with reference thereto.

The flap 22 comprises a front portion 30 for directly underlying the belt 17.

The flap 22 further comprises a back portion 32 for directly overlying the waistband 13 of the pants 12.

The front portion 30 of the flap 22 depends from, and is one-piece with, the body 14 and the back portion 32 extends upwardly from, is disposed behind, and is one-piece with, the front portion 30 of the flap 22.

The back portion 32 of the flap 22 is stitched to the front portion 30 where the body 14 meets the shirttail 20 so as to form a channel 34 that is formed by the body 14 merely being hemmed where it meets the shirttail 20.

The flap 22 has openings 36 that extend alingingly through the front portion 30 thereof and the back portion 32 thereof and are for aligning with, and allowing passage through, of the belt loops 15, and when the belt loops 15 extend through the openings 36 in the flap 22, the belt 17 is passed through the belt loops 15 and overlies the flap 22, and when the shirttail 20 is in the pants 12 and the belt 17 is fastened, the belt 17 presses the flap 22 against the waistband 13 and traps the waistband 13 between the flap 22 and the shirttail 20, and in doing so, prevents the sand from entering the pants 12 when the user slides.

Figure 4:
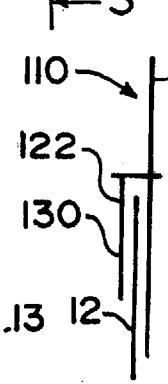
FIG. 4 is a diagrammatic view of a second embodiment of the present invention.

The configuration of a second embodiment of the shirt 110 can best be seen in FIG. 4, and as such, will be discussed with reference thereto.

The shirt 110 is similar to the shirt 10, except that the flap 122 comprises only the front portion 130 and that the front portion 130 is separate from, and sewn to, the body 114.

Figure 5:
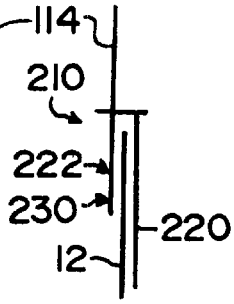
FIG. 5 is a diagrammatic view of a third embodiment of the present invention.

The configuration of a third embodiment of the shirt 210 can best be seen in FIG. 5, and as such, will be discussed with reference thereto.

The shirt 210 is similar to the shirt 10, except that the flap 222 comprises only the front portion 230 and the shirttail 220 is sewn to the body 214.

It will be understood that each of the elements described above, or two or more together, may also find a useful application in other types of constructions differing from the types described above.

While the invention has been illustrated and described as embodied in a garment for a user wearing pants and for preventing sand from entering the pants when the user slides, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A shirt for a user wearing pants and for preventing sand from entering the pants when the user slides, wherein the pants has a waistband with belt loops that receive a belt, said shirt comprising:

a) a body;

b) a pair of sleeves extending oppositely from said body;

c) a neck band disposed on said body, between said pair of sleeves;

d) a shirttail depending from said body for engaging in the pants; and e) a front placket extending from said neck band to said shirttail; further comprising a flap extending circumferentially and completely therearound, depending from where said body meets said shirttail, and is for overlapping the waistband of the pants when the shirttail is in the pants, and in doing so, prevents the sand from entering the pants when the user slides, wherein said flap comprises a front portion for directly underlying the belt.

2. The shirt as defined in claim 1, wherein said flap is divided at, so as to communicate with, said front placket.

3. The shirt as defined in claim 1; further comprising fasteners selectively closing said front placket.

4. The shirt as defined in claim 3, wherein said fasteners comprise hook and loop fasteners on said flap and snaps elsewhere.

5. The shirt as defined in claim 1, wherein said front portion of said flap has front openings that extend therethrough and are for aligning with, and allowing passage through, of the belt loops, and when the shirttail is in the pants and the belt loops extend through said front openings in said front portion of said flap, the belt is passed through the belt loops and overlies said front portion of said flap, and when the belt is fastened, the belt presses said front portion of said flap against the waistband of the pants and traps the waistband of the pants between said front portion of said flap and the shirttail, and in doing so, prevents the sand from entering the pants when the user slides.

6. The shirt as defined in claim 5, wherein said flap further comprises a back portion for directly overlying the waistband of the pants.

7. The shirt as defined in claim 6, wherein said front portion of said flap depends from, and is one-piece with, said body and said back portion extends upwardly from, is disposed behind, and is one-piece with, said front portion of said flap.

8. The shirt as defined in claim 7, wherein said back portion of said flap is stitched to said front portion where said body meets said shirttail so as to form a channel that is formed by said body merely being hemmed where it meets said shirttail.

9. The shirt as defined in claim 6, wherein said back portion of said flap has back openings that extend therethrough and which align with said front openings in said front portion of said flap and are for aligning with, and allowing passage through, of the belt loops, and when the shirttail is in the pants and the belt loops extend through said back openings and said front openings in said flap, the belt is passed through the belt loops and overlies said front portion of said flap, and when the belt is fastened, the belt presses said flap against the waistband of the pants and traps the waistband of the pants between said flap and the shirttail, and in doing so, prevents the sand from entering the pants when the user slides.

10. The shirt as defined in claim 5, wherein said front portion of said flap is separate from, and sewn to, said body.

11. The shirt as defined in claim 5, wherein said shirttail is sewn to said body.

* * * * *